US010451047B2

(12) United States Patent
Male et al.

(10) Patent No.: US 10,451,047 B2
(45) Date of Patent: Oct. 22, 2019

(54) PUMP UNIT AND METHOD OF OPERATING THE SAME

(71) Applicant: DELPHI TECHNOLOGIES IP LIMITED, St. Michael (BB)

(72) Inventors: Andrew Male, Walton on Thames (GB); Anthony Thomas Harcombe, Surrey (GB)

(73) Assignee: DELPHI TECHNOLOGIES IP LIMITED (BB)

( * ) Notice: Subject to any disclaimer, the term of this patent is extended or adjusted under 35 U.S.C. 154(b) by 289 days.

(21) Appl. No.: 14/425,939

(22) PCT Filed: Jul. 23, 2013

(86) PCT No.: PCT/EP2013/065536
§ 371 (c)(1),
(2) Date: Mar. 4, 2015

(87) PCT Pub. No.: WO2014/037146
PCT Pub. Date: Mar. 13, 2014

(65) Prior Publication Data

US 2015/0211459 A1 Jul. 30, 2015

(30) Foreign Application Priority Data

Sep. 6, 2012 (EP) ..... 12183360

(51) Int. Cl.
*F04B 9/00* (2006.01)
*F02M 59/02* (2006.01)
(Continued)

(52) U.S. Cl.
CPC ..... *F04B 7/0076* (2013.01); *F02M 59/02* (2013.01); *F02M 59/027* (2013.01);
(Continued)

(58) Field of Classification Search
USPC ..... 123/446, 495, 496, 497, 498, 499, 500, 123/501, 502, 503, 504, 505, 506
See application file for complete search history.

(56) References Cited

U.S. PATENT DOCUMENTS 1,664,608 A * 4/1928 French ..... F02M 59/366 123/357
3,709,639 A * 1/1973 Suda ..... F02M 59/366 123/499
(Continued)

FOREIGN PATENT DOCUMENTS

JP 11-280603 A 10/1999
WO 00/06895 A1 2/2000
(Continued)

OTHER PUBLICATIONS

International Search Report dated Sep. 12, 2013.

*Primary Examiner* — Peter J Bertheaud
*Assistant Examiner* — Geoffrey Lee
(74) *Attorney, Agent, or Firm* — Joshua M. Haines

(57) ABSTRACT

The present application relates to a pump unit for a fuel injection system. The pump unit has a low pressure fuel supply line and a high pressure fuel outlet. A pumping chamber having a plunger is operable to perform a pumping cycle comprising a pumping stroke and a filling stroke. The pump unit also includes an inlet valve having an inlet valve member movable between an open position for permitting the supply of fuel to the pumping chamber from the low pressure fuel supply line and a closed position for inhibiting the supply of fuel from the pumping chamber to the low pressure supply line. An outlet valve is provided in the high pressure fuel outlet. The pump unit also includes a means for latching the inlet valve member in its open position. The present application also relates to a method of operating a pump unit.

20 Claims, 2 Drawing Sheets

(51) Int. Cl.

| | |
|---|---|
| ***F04B 19/22*** | (2006.01) |
| ***F04B 7/02*** | (2006.01) |
| ***F04B 7/00*** | (2006.01) |
| ***F04B 53/10*** | (2006.01) |
| ***F02M 59/34*** | (2006.01) |
| ***F02M 59/36*** | (2006.01) |
| ***F04D 15/00*** | (2006.01) |
| ***F02M 63/00*** | (2006.01) |
| ***F02M 59/46*** | (2006.01) |

(52) U.S. Cl.

CPC ..... *F02M 59/34* (2013.01); *F02M 59/36* (2013.01); *F02M 59/367* (2013.01); *F02M 59/466* (2013.01); *F02M 63/0024* (2013.01); *F02M 63/0033* (2013.01); *F04B 7/02* (2013.01); *F04B 53/109* (2013.01); *F04B 53/1092* (2013.01); *F04D 15/0072* (2013.01)

(56) References Cited

U.S. PATENT DOCUMENTS 3,851,635 A * 12/1974 Murtin ..... F02D 41/40 123/448
4,378,775 A * 4/1983 Straubel ..... F02M 59/366 123/446
4,463,725 A * 8/1984 Laufer ..... F02M 59/366 123/446
4,623,118 A * 11/1986 Kumar ..... F15B 13/015 137/596.16
4,804,314 A * 2/1989 Cusack ..... F04B 17/046 310/26
4,805,571 A * 2/1989 Humphrey ..... F01L 1/348 123/25 C
5,351,893 A * 10/1994 Young ..... F02M 51/04 239/570
5,626,325 A * 5/1997 Buchanan ..... F02M 57/023 137/539.5
6,142,125 A * 11/2000 Shimayama ..... F02M 39/02 123/450
6,199,767 B1 * 3/2001 Male ..... F02M 47/043 239/5
6,267,306 B1 * 7/2001 Phillips ..... F02M 47/027 239/127
6,321,999 B1 * 11/2001 Male ..... F02M 57/02 239/96
6,332,454 B1 * 12/2001 Itabashi ..... F02D 41/062 123/490
6,345,608 B1 * 2/2002 Rembold ..... F02M 59/34 123/456
6,447,273 B1 * 9/2002 Nishimura ..... F02M 59/102 123/446
6,918,409 B1 * 7/2005 Parker ..... F02M 37/0023 137/614.11
7,063,073 B2 * 6/2006 Ausiello ..... F02M 59/265 123/446
7,198,034 B2 * 4/2007 Ausiello ..... F02M 59/265 123/506
7,216,632 B2 * 5/2007 Nagatomo ..... F02M 45/086 123/300
7,472,691 B2 * 1/2009 Nagatomo ..... F02M 45/086 123/467
7,757,669 B2 * 7/2010 Okamoto ..... F02D 41/3845 123/508
7,971,802 B2 * 7/2011 Male ..... F02M 45/12 239/585.5
8,752,524 B2 * 6/2014 McAlister ..... F02M 57/06 123/143 B
9,309,849 B2 * 4/2016 Tanabe ..... F02M 59/366
9,435,334 B2 * 9/2016 Furuhashi ..... F02D 41/08
2002/0025260 A1 * 2/2002 Maruyama ..... F04B 17/003 417/322
2002/0155011 A1 * 10/2002 Hartnagel ..... F04B 7/0015 417/417
2003/0172978 A1 * 9/2003 Rodriguez-Amaya ..... F02M 63/0007 137/625.65
2006/0222518 A1 * 10/2006 Oda ..... F02M 59/366 417/298
2006/0283424 A1 * 12/2006 Nagatomo ..... F02M 45/086 123/467
2007/0164134 A1 * 7/2007 Nagatomo ..... F02M 45/086 239/585.1
2010/0074783 A1 * 3/2010 Inoue ..... F04B 1/0408 417/505
2014/0123953 A1 * 5/2014 McAlister ..... F02M 57/06 123/472
2014/0306034 A1 * 10/2014 Schmieder ..... F02M 51/0678 239/585.5
2015/0136090 A1 * 5/2015 Maess ..... F02D 41/20 123/482
2016/0131097 A1 * 5/2016 Matsuo ..... F02M 59/025 123/495
2016/0222934 A1 * 8/2016 Oki ..... F02M 59/025
2016/0298587 A1 * 10/2016 Nakano ..... F02M 51/04
2017/0009721 A1 * 1/2017 Albrecht ..... F02M 55/007
2017/0009722 A1 * 1/2017 Stritzel ..... F02M 59/06
2017/0009767 A1 * 1/2017 Stritzel ..... F16J 1/008
2017/0030314 A1 * 2/2017 Fitzner ..... F04B 53/16

FOREIGN PATENT DOCUMENTS

WO 2010/119086 A1 10/2010
WO 2011/003789 A1 1/2011
WO 2011/058344 A1 5/2011

* cited by examiner

PUMP UNIT AND METHOD OF OPERATING THE SAME

CROSS REFERENCE TO RELATED APPLICATIONS

This application is a national stage application under 35 U.S.C. 371 of PCT Application No. PCT/EP2013/065536 having an international filing date of 23 Jul. 2013, which designated the United States, which PCT application claimed the benefit of European Patent Application No. 12183360.2 filed on 6 Sep. 2012, the entire disclosure of each of which are hereby incorporated herein by reference.

TECHNICAL FIELD

The present invention relates to a pump unit for a fuel injection system; and a method of operating a pump unit. The present invention also relates to a valve for a fuel injection system.

BACKGROUND OF THE INVENTION

It is known from the Applicant's earlier application WO 2011/003789 to provide a pump unit comprising an axial inlet valve. A spring-biased inlet valve member is provided for controlling the supply of fuel to a pumping chamber from a low pressure supply line. The inlet valve member is displaced to an open or closed position in response to a positive or negative pressure differential. The pump unit allows a metered volume of fuel to be delivered to a high pressure manifold. However, the pump unit cannot readily vary the volume of fuel delivered during each pump cycle and additional metering systems may be required for some applications.

The present invention, at least in certain embodiments, sets out to provide an improved pump unit.

SUMMARY OF THE INVENTION

Aspects of the present invention relate to a pump unit, a method of operating a pump unit and a pump inlet valve assembly.

In a further aspect, the present invention relates to a pump unit for a fuel injection system, the pump unit comprising:

a. a low pressure fuel supply line;
b. a pumping chamber having a plunger operable to perform a pumping cycle comprising a pumping stroke and a filling stroke;
c. an inlet valve having an inlet valve member movable between an open position for permitting the supply of fuel to the pumping chamber from the low pressure fuel supply line and a closed position for inhibiting the supply of fuel from the pumping chamber to the low pressure supply line; and
d. a high pressure fuel outlet having an outlet valve;
e. wherein the pump unit further comprises means for latching the inlet valve member in said open position.

The latching means can comprise a latch or a latch mechanism operable to latch the inlet valve member in said open position. The latching means can latch the inlet valve member to control the closing action of the inlet valve member. In use, the latching means can be controlled to meter the volume of fuel pumped by the pump unit. The inlet metering valve can be held in said latched position to control the volume of fuel expelled from the pumping chamber. Thus, the pump unit can provide inlet valve metering. The pumping chamber can be placed in sole fluid communication with the outlet valve when the inlet valve member is in said closed position.

The latching means can be operated to control the closing of the inlet valve member. For example, the latching means can be operable to latch the inlet valve member in said open position for at least part of the pumping stroke of the plunger. In use, the latching means can unlatch (release) the inlet valve member during the pumping stroke of the plunger. Controlling the timing of unlatching the inlet valve member in relation to the pumping stroke of the plunger can allow the volume of fuel in the pumping chamber to be metered. For example, delaying the unlatching of the inlet valve member during the pumping stroke can increase the volume of fuel expelled from the pumping chamber before the inlet valve member is displaced to said closed position; the volume of fuel pressurised in the pumping chamber and delivered to the fuel outlet is thereby reduced.

In use, the inlet valve member can be displaced to said open position and/or said closed position by a pressure differential. A reduced pressure in the pumping chamber, for example when the plunger performs a filling stroke, can establish a pressure differential across the inlet valve member which displaces the inlet valve member to the open position. Conversely, an increased pressure in the pumping chamber, for example when the plunger performs a pumping stroke, can establish a pressure differential across the inlet valve member which displaces the inlet valve member to the closed position.

Alternatively, or in addition, the latching means can be configured to generate an opening force to displace the inlet valve member towards said open position. For example, it may be appropriate to activate the latching means to apply an opening force at low operating speeds when the pressure differential may be relatively small. Conversely, at high operating speeds, the pressure differential may be greater and it may not be necessary to activate the latching means to apply an opening force to the inlet valve member.

The opening force could be sufficient to displace the inlet valve member to said open position from said closed position; or to displace the inlet valve member to said open position from an interim position between said open and closed positions. The latching means can be configured to apply an opening force to displace the inlet valve member to said open position when it is proximal to the open position or in said open position. Activating the latching means when the air gap is small can reduce the power required to latch the inlet valve member.

A spring member can be provided for biasing the inlet valve member towards said open position or towards said closed position.

The inlet valve member can comprise an armature for activation by a magnetic field.

The latching means and the inlet valve member in combination form an inlet latching valve. The latching means can comprise an electromagnet or a solenoid for establishing a first magnetic field when activated. The first magnetic field can act on the armature to latch the inlet valve member in said open position. The inlet valve member can be latched in said open position by the electromagnet.

The latching means can comprise a combination of an electromagnet and a permanent magnet. The electromagnet can selectively establish a first magnetic field; and the permanent magnet can establish a second magnetic field. The second magnetic field can act on the armature to latch the inlet valve member is said open position. Thus, the inlet valve member can be latched in said open position by the permanent magnet. The electromagnet can be selectively activated to unlatch the inlet valve member. The first and second magnetic fields can be opposite to each other. Activating the electromagnet can reduce a latching force applied by the permanent magnet to unlatch the inlet valve member. The first magnetic field can partially or completely cancel the second magnetic field. The combination of a permanent magnet and an electromagnet to control the operation of a valve unit is believed to be independently patentable.

The inlet valve member can comprise an aperture, such as a bore, for selectively establishing fluid communication between the pumping chamber and either the fuel supply line or the outlet valve. The aperture can be an axial bore, for example.

In a further aspect, the present invention relates to a method of operating a pump unit, the method comprising the following steps:

(a) displacing an inlet valve member to an open position to establish fluid communication between a low pressure fuel supply line and a pumping chamber;

(b) latching the inlet valve member in said open position; and (c) initiating a plunger pumping stroke within the pumping chamber when the inlet valve member is latched in said open position. The inlet valve member can be latched in said open position for part or all of the plunger pumping stroke. The volume of fuel pumped by the pump unit during a pumping cycle can be metered by controlling the latching of the inlet valve member.

The method can include the additional step of: (d) unlatching the inlet valve member during the plunger pumping stroke. The unlatching of the inlet valve member can be controlled to meter the volume of fuel in the pumping chamber. After the inlet valve member has been unlatched, the inlet valve member can be displaced to a closed position to inhibit fluid communication between the low pressure fuel supply line and the pumping chamber.

The pump unit can be controlled to maintain the inlet valve member latched throughout the plunger pumping stroke. This control technique can be used to prevent fuel being pressurised within the pumping chamber.

The inlet valve member can be biased towards said closed position or towards said open position. A spring member can be provided for biasing the inlet valve member.

The inlet valve member can be pressure operated. A pressure differential can be established across the inlet valve member to displace the inlet valve member. The inlet valve member can be displaced to said open position by retracting the plunger within the pumping chamber. Conversely, the inlet valve member can be displaced to said closed position by advancing the plunger within the pumping chamber. The latching means can be activated to assist in displacing the inlet valve member from a position proximal to said open position to said open position. The latching means can engage the inlet valve member when it is in said open position to latch it open. The method can comprise activating the latching means before or as the inlet valve member reaches said open position.

The present invention also relates to an electronic control unit configured to perform the method described herein. The electronic control unit can comprise one or more microprocessors programmed with instructions for controlling operation of the pump unit in accordance with the method described herein.

In a yet further aspect, the present invention relates to a pump inlet valve for a fuel injection system, the valve comprising:

a. a valve member movable between a first position and a second position;

b. a permanent magnet for latching said valve member in said first position; and c. an electromagnet operable to unlatch said valve member.

The pump inlet valve could be pressure operated, for example biased to an open position or a closed position in response to a pressure differential. Alternatively, or in addition, the pump inlet valve can comprise a biasing member for biasing the valve member towards said second position.

The valve member can be operable to meter a volume of low pressure fuel in a pumping chamber. The valve can be configured to meter a volume of low pressure fuel supplied to the pumping chamber; and/or to meter a volume of low pressure fuel expelled from the pumping chamber.

The first position can be an open position and the second position can be a closed position. Alternatively, the first position can be a closed position and the second position can be an open position.

In a still further aspect, the present invention relates to a method of operating a pump inlet valve comprising a permanent magnet configured to generate a first magnetic field to latch a valve member, the method comprising activating an electromagnet to generate a second magnetic field at least partially to counter said first magnetic field and unlatch said valve member.

The method can comprise activating the electromagnet to generate said second magnetic field for a predetermined period of time. The electromagnet can, for example, be pulsed to unlatch the inlet valve member. Alternatively, the electromagnet can operate over a portion of a pumping cycle.

The permanent magnet can be configured to latch the valve member in an open position or a closed position. The valve member can optionally be biased towards the open position or the closed position.

The method can include the step of controlling activation of the electromagnet to meter a volume of fluid. The electromagnet can be controlled to meter a volume of fluid entering a pump chamber; and/or a volume of fluid exiting a pump chamber.

Within the scope of this application it is expressly intended that the various aspects, embodiments, examples and alternatives set out in the preceding paragraphs, in the claims and/or in the following description and drawings, and in particular the individual features thereof, may be taken independently or in any combination. For example, features described with reference to one embodiment are applicable to all embodiments, unless such features are incompatible.

BRIEF DESCRIPTION OF THE DRAWINGS

An embodiment of the present invention will now be described, by way of example only, with reference to the accompanying figures, in which.

a.

DETAILED DESCRIPTION OF AN EMBODIMENT

Figure 1:
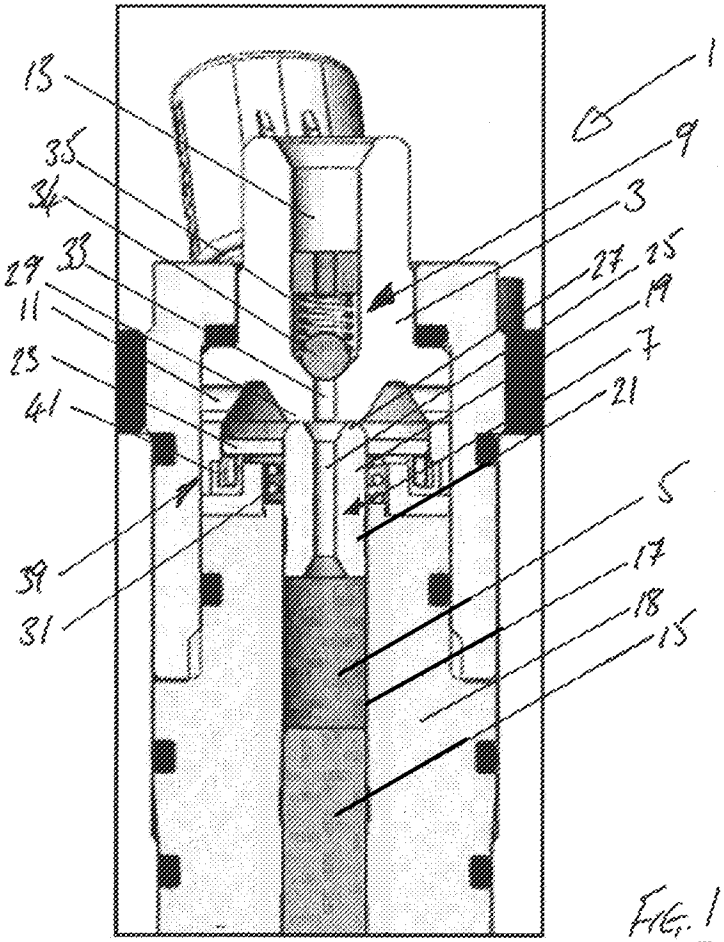
FIG. 1 shows a schematic representation of a pump unit in accordance with the present invention; and b.

A pump unit 1 according to a first embodiment of the present invention is shown in FIG. 1. The pump unit 1 comprises a pump head 3, a pumping chamber 5, an inlet valve 7 and an outlet valve 9. The fuel is supplied to the pumping chamber 5 from a low pressure inlet gallery 11 and is expelled from the pumping chamber 5 to a high pressure manifold 13.

A plunger 15 is provided in the pumping chamber 5 for pressurising fuel. A cam mounted to a rotatable camshaft cooperates with a lower end of the plunger 15 to reciprocate the plunger 15. In use, the plunger 15 performs a pumping cycle comprising a pumping stroke and a filling stroke. The plunger 15 is mounted in a bore 17 formed in the pump head 3 and a seal is formed between the plunger 15 and the bore 17 in known manner.

The inlet valve 7 comprises an inlet valve member 19 for controlling the flow of fuel into the pumping chamber 5. As described in more detail herein, the inlet valve member 19 is also operable to meter the volume of fuel within the pumping chamber 5. The inlet valve member 19 is movable axially between an open position in which the pumping chamber 5 is in fluid communication with the low pressure inlet gallery 11; and a closed position in which fluid communication between the pump chamber 5 and the low pressure inlet gallery 11 is exhausted.

The inlet valve member 19 comprises a cylindrical body 21 and a disc-shaped armature 23. The cylindrical body 21 comprises an axial bore 25; and an annular valve 27. The annular valve 27 is formed at the top of the cylindrical body 21 and cooperates with a first valve seat 29 formed in the pump head 3 to seal the pumping chamber 5 when the inlet valve member 19 is in its closed position. An inlet return spring 31 is provided to bias the inlet valve member 19 towards said closed position.

An outer wall of the cylindrical body 21 forms a seal with an inside wall of the bore 17. The axial bore 25 extends through the cylindrical body 21 and forms the sole inlet/outlet for the pumping chamber 5. In use, when the inlet valve member 19 is in said closed position, high pressure fuel in the axial bore 25 causes the cylindrical body 21 to expand radially and provide an improved seal with the bore 17. When the inlet valve member 19 is in said open position, the inlet gallery 11 is in fluid communication with the pumping chamber 5 via the axial bore 25 to allow fuel to enter the pumping chamber 5. When the inlet valve member 19 is in said closed position (i.e. the annular valve 27 is seated in the first valve seat 29), the pumping chamber 5 is in fluid communication exclusively with the outlet valve 9 via the axial bore 25.

The outlet valve 9 controls the supply of pressurised fuel from the pumping chamber 5 to the high pressure manifold 3. An axial communication channel 33 is formed in the pump head 3 to provide a fluid pathway from the pumping chamber 5 to the outlet valve 9. The outlet valve 9 comprises a movable outlet valve member 34, an outlet return spring 35, and a second valve seat 37. The outlet return spring 35 biases the outlet valve member 34 towards the second valve seat 31 to close the outlet valve 9. The biasing force of the outlet return spring 35 on the outlet valve member 34 and the hydraulic pressure of fuel in the high pressure manifold 13 must be overcome to open the outlet valve 9.

A latch 39 is provided to latch the inlet valve member 19. The latch 39 comprises a solenoid 41 for establishing a magnetic field to engage the armature 23 and retain the inlet valve member 19 in its open position. The solenoid 41 has a circular plan form and extends around the inlet valve member 19. In the present embodiment, the magnetic field established by the solenoid 41 is insufficient to displace the inlet valve member 19 from said closed position to said open position. Rather, the inlet valve member 19 is displaced at least substantially to said open position by a negative pressure differential established across the inlet valve member 19 when the plunger 15 performs a filling stroke. The solenoid 41 is activated to latch the inlet valve member 19 when the inlet valve member 19 is positioned in said open position (or proximal to said open position). The magnetic field established by the solenoid 41 is sufficient to retain the inlet valve member 19 in said open position. Specifically, the solenoid 41 generates a latching force greater than the combination of the spring bias of the inlet return spring 31 and a positive pressure differential across the inlet valve member 19 established when the plunder 15 performs a pumping stroke. The latch 39 can thereby latch the inlet valve member 19 in said open position.

The latch 39 can control the inlet valve member 19 to meter the volume of fuel in the pumping chamber 5. In particular, the inlet valve member 19 can be latched in said open position to delay or prevent closing of the inlet valve member 19. While the inlet valve member 19 is latched in said open position, fuel in the pumping chamber 5 can be returned to the inlet gallery 11 when the plunger 15 performs a pumping stroke. By controlling the unlatching (i.e. release) of the inlet metering valve 19, the volume of fuel returned to the inlet gallery 11 from the pumping chamber 5 can be controlled. The volume of high pressure fuel pressurised in the pumping chamber 5 and supplied to the manifold 13 via the outlet valve 9 can be metered. If the inlet valve member 19 is latched in said open position at least substantially for the duration of a pumping stroke of the plunger 15, the pumping chamber 5 is not sealed and the pumping cycle of the plunger 15 can be performed without introducing high pressure fuel to the manifold 13. The volume of high pressure fuel supplied to the manifold 13 can thereby be controlled.

The latch 39 is controlled by an electronic control unit (not shown). The pump unit is provided with an electrical connector for connection to the electronic control unit. An array of the pump units 1 can be controlled by the electronic control unit.

Figure 2:
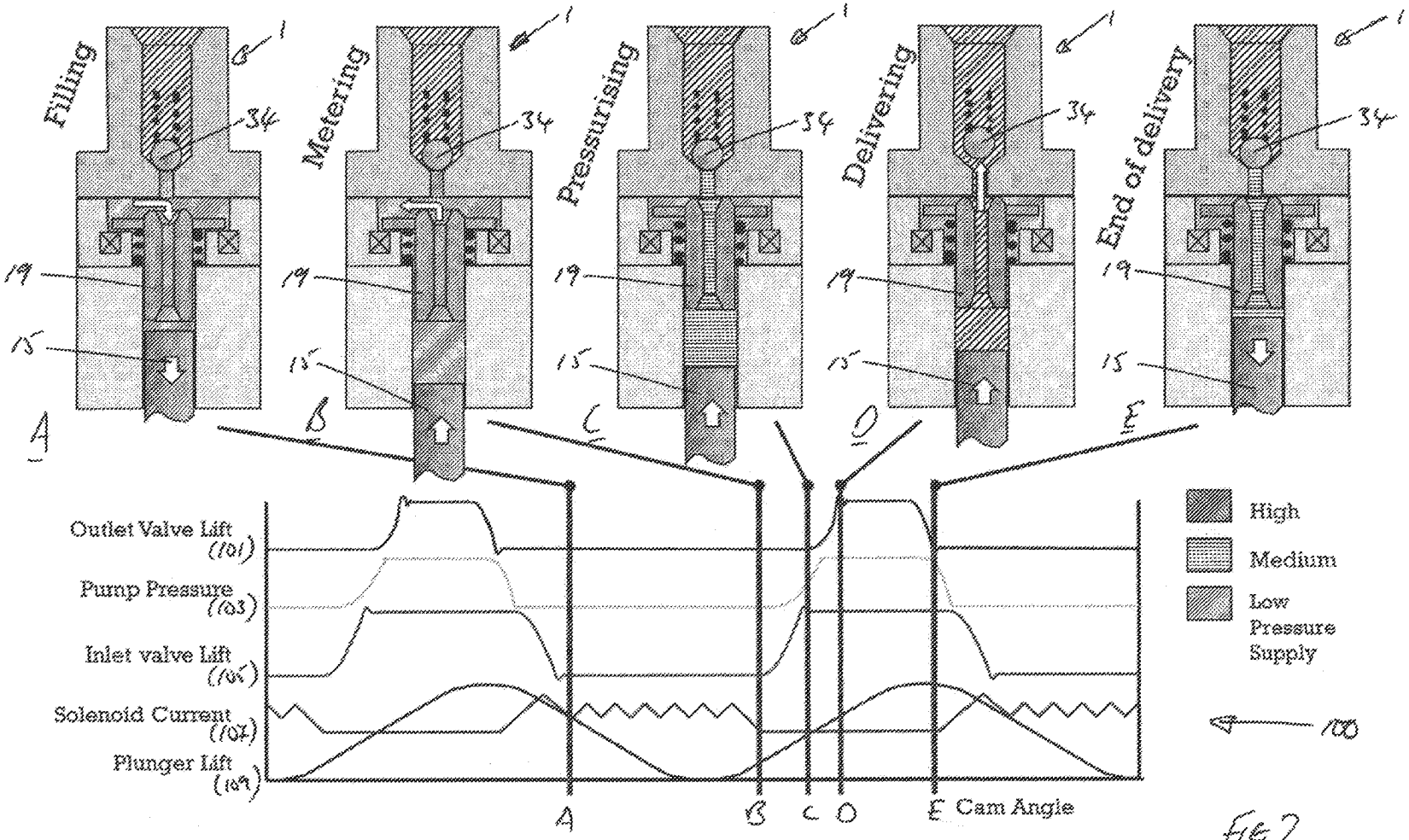
FIG. 2 shows the pump unit of FIG. 1 in a series of positions alongside an operational chart.

The operation of the pump unit 1 according to the present invention will now be described with reference to FIG. 2. The pump unit 1 is illustrated in five operating positions A-E in FIG. 2. An operational chart 100 is also shown illustrating the outlet valve lift (101); the pump pressure (103); the inlet valve lift (105); the solenoid current (107); and the plunger lift (109) in each of the five operating positions A-E. It will be appreciated that the plunger lift (109) is determined by an operating angle of the drive cam.

The plunger 15 is illustrated performing a filling stroke in position A. The filling stroke reduces the pressure within the pumping chamber 5 and establishes a negative pressure differential across the inlet valve member 19 causing the inlet valve member 19 to be displaced towards said open position. A current is applied to the solenoid 41 to activate the latch 39 and establish a magnetic field. The magnetic field can attract the armature 23 thereby helping to displace the inlet valve member 19 to said open position.

The current to the solenoid 41 is maintained to latch the inlet valve member 19 in the open position for the remainder of the filling stroke. The plunger 15 then initiates a pumping stroke and increases the pressure within the pumping chamber 5 establishing a positive pressure differential across the inlet valve member 19. However, the supply of current to the solenoid 41 is maintained to latch the inlet valve member 19 in said open position. The pumping stroke of the plunger 15 thereby expels fuel from the pumping chamber 5, as illustrated in position B of FIG. 2. By controlling the time period over which the inlet valve member 19 is latched in said open position, the volume of fuel in the pumping chamber 5 can be metered.

In the present arrangement, the supply of current to the solenoid 41 is terminated during the pumping stroke of the plunger 15 to unlatch (release) the inlet valve member 19. The spring bias provided by the inlet return spring 31 and the positive pressure differential across the inlet valve member 19 displace the inlet valve member 19 to its closed position, as illustrated in position C of FIG. 2. The annular valve 27 seats in the first valve seat 29 to place the pumping chamber 5 in exclusive fluid communication with the outlet valve 9. The plunger 15 continues its pumping stroke and pressurises the fuel within the pumping chamber 5. When the pressure in the pumping chamber 5 is sufficient to overcome the spring bias of the outlet return spring 35 and the hydraulic pressure of the high pressure fuel in the manifold 13, the outlet valve member 34 lifts off the second valve seat 37 and high pressure fuel is expelled from the pumping chamber 5 into the manifold 13, as illustrated in position D of FIG. 2.

The plunger 15 completes the pumping stroke and initiates another filling stroke. As illustrated in position E of FIG. 2, the pressure in the pumping chamber 15 decreases and the outlet valve member 34 is seated in the second valve seat 37. The reduction of pressure in the pumping chamber 15 establishes a negative pressure differential across the inlet valve member 19 and the inlet valve member 19 travels towards the open position. The current to the solenoid 39 is re-applied to latch the inlet valve member 19 in the open position.

It will be appreciated that the latch 39 can control the latching and unlatching of the inlet valve member 19 to meter the volume of fuel pumped into the manifold 13 during each pump cycle. Moreover, if the latch 39 latches the inlet valve member 19 in said open position for the duration of the pumping stroke of the plunger 15, the pumping chamber 5 is not sealed and pressurised fuel is not delivered to the manifold 13.

A modified arrangement of the latch 39 will now be described. A permanent magnet can be provided for establishing a first magnetic field to latch the inlet valve member 19 in its open position. An electromagnet is provided to establish a second magnetic field at least partially to counter or disrupt the first magnetic field and unlatch the inlet valve member 19. The inlet valve member 19 can then be displaced to said closed position by the inlet return spring 31 and the positive pressure differential established by the plunger 15 performing said pumping stroke. A pulse of current could be supplied to the electromagnet to unlatch the inlet valve member 19. The operation of the pump unit 1 using a modified latch 39 is unchanged from the embodiment described above. In particular, the latch 39 can meter the volume of fuel pumped during each pump cycle. This modified arrangement can reduce power consumption as the operation of the electromagnet is reduced.

It will be appreciated that various changes and modifications can be made to the pump unit described herein without departing from the spirit and scope of the present invention.

The invention claimed is:

1. A pump unit for a fuel injection system, the pump unit comprising:

a low pressure fuel supply line;

a pumping chamber having a plunger operable to perform a pumping cycle comprising a pumping stroke and a filling stroke;

an inlet valve having a valve seat and an inlet valve member movable between an open position apart from the valve seat for permitting the supply of fuel to the pumping chamber from the low pressure fuel supply line and a closed position seated with the valve seat for inhibiting the supply of fuel from the pumping chamber to the low pressure supply line;

a high pressure fuel outlet having an outlet valve; and means for latching the inlet valve member in said open position;

wherein the inlet valve member comprises a bore for selectively establishing fluid communication between the pumping chamber and either the fuel supply line or the outlet valve, the inlet valve member also comprises an armature;

wherein the means for latching comprises a solenoid which circumferentially surrounds the inlet valve member when the inlet valve member is in the closed position such that current applied to the solenoid establishes a magnetic field which magnetically attracts the armature and latches the inlet valve member in said open position and such that termination of current to the solenoid stops magnetic attraction of the armature and unlatches the inlet valve member.

2. A pump unit as claimed in claim 1, wherein the latching means is operable to latch the inlet valve member in said open position for at least part of said pumping stroke of the plunger.

3. A pump unit as claimed in claim 2, wherein the latching means is operable to unlatch the inlet valve member during the pumping stroke of the plunger to meter the volume of fuel in the pumping chamber.

4. A pump unit as claimed in claim 1, wherein, in use, the inlet valve member is displaced to said open position by a pressure differential across the inlet valve member; and/or by an opening force applied to the inlet valve member by said latching means.

5. A pump unit as claimed in claim 1, wherein the latching means is operable to latch the inlet valve member in said open position when the inlet valve member is in said open position or proximal to said open position.

6. A pump unit as claimed in claim 1, further comprising a spring member for biasing the inlet valve member towards said closed position.

7. A pump unit as claimed in claim 1, wherein said latching means comprises an electromagnet.

8. A pump unit as claimed in claim 7, wherein said latching means additionally comprises a permanent magnet.

9. A pump unit as claimed in claim 1, wherein the bore moves with the inlet valve member when the inlet valve member move between the open position and the closed position.

10. A pump unit as in claim 1 wherein the inlet valve member comprises a body which defines the bore, the body extending through with an aperture defined by the armature.

11. A pump unit as claimed in claim 1, wherein the pump unit further comprises a pump head which defines the pumping chamber, the solenoid being located within the pump head.

12. A pump unit as claimed in claim 11, wherein the pump head defines a pump head bore which circumferentially surrounds the inlet valve member, the solenoid being located within the pump head bore.

13. A pump unit as claimed in claim 1, wherein the outlet valve includes an outlet valve member that is distinct from the pumping plunger and is also distinct from the inlet valve member, the outlet valve also includes an outlet valve seat which is distinct from the valve seat of the inlet valve, the outlet valve member being moveable between 1) an outlet valve open position apart from the outlet valve seat which provides fluid communication from the plunger to the high pressure fuel outlet and 2) an outlet valve closed position seated with the outlet valve seat which prevents fluid communication from the plunger to the high pressure fuel outlet.

14. A pump unit as claimed in claim 13, wherein the outlet valve member moves between the outlet valve open position and the outlet valve closed position in response to pressure within the pumping chamber.

15. A method of operating a pump unit, the method comprising the following steps:

(a) displacing an inlet valve member with an armature to an open position which is apart from a valve seat to establish fluid communication between a low pressure fuel supply line and a pumping chamber through a bore in the inlet valve member;

(b) latching the inlet valve member in said open position using a means for latching the inlet valve member which comprises a solenoid which circumferentially surrounds the inlet valve member when the inlet valve member is in the closed position, wherein latching the inlet valve member includes applying current to the solenoid which magnetically attracts the armature and latches the inlet valve member in said open position;

(c) initiating a plunger pumping stroke within the pumping chamber when the inlet valve member is latched in said open position; and (d) unlatching the inlet valve member during the plunger pumping stroke to displace the inlet valve member to a closed position which is seated with the valve seat to inhibit fluid communication between the low pressure fuel supply line and the pumping chamber and to establish fluid communication between the pumping chamber and an outlet valve through the bore in the inlet valve member, wherein unlatching the inlet valve member includes terminating current to the solenoid which stops magnetic attraction of the armature and unlatches the inlet valve member.

16. A method as claimed in claim 15, wherein the unlatching of the inlet valve member is controlled to meter the volume of fuel in the pumping chamber.

17. A method as claimed in claim 15, wherein the inlet valve member is latched throughout the plunger pumping stroke.

18. A method as claimed in claim 15, wherein the inlet valve member is biased towards said closed position.

19. A method as claimed in claim 15, wherein a latching means for latching the inlet valve member in said open position is activated before the inlet valve member reaches said open position.

20. A method as claimed in claim 15, wherein the bore moves with the inlet valve member when the inlet valve member is displaced between the open position and the closed position.

* * * * *